United States Patent [19]

March et al.

[11] Patent Number: 5,013,034

[45] Date of Patent: May 7, 1991

[54] EXERCISE MACHINE

[75] Inventors: Adrian A. C. March, Bordon; Graham C. Laskey, Hindhead, both of United Kingdom

[73] Assignee: Health Habit Developments Limited, United Kingdom

[21] Appl. No.: 488,509

[22] Filed: Mar. 5, 1990

Related U.S. Application Data

[63] Continuation of Ser. No. 92,320, Sep. 2, 1987, abandoned.

[30] Foreign Application Priority Data

Sep. 3, 1986 [GB] United Kingdom ..... 8621216

[51] Int. Cl.[5] ..... A63B 21/22

[52] U.S. Cl. ..... 272/132; 272/145

[58] Field of Search ..... 272/131, 132, 145, 70, 272/97, DIG. 4, 72

[56] References Cited

U.S. PATENT DOCUMENTS

| | | | |
|---|---|---|---|
| 212,946 | 3/1879 | Johnson | 272/132 |
| 1,577,809 | 3/1926 | Randall | 272/72 |
| 2,126,443 | 8/1938 | Begley | 272/132 |
| 3,782,721 | 1/1974 | Passera | 272/132 |
| 3,957,266 | 5/1976 | Rice | 272/131 X |
| 4,603,856 | 8/1986 | Fiore | 272/131 |

FOREIGN PATENT DOCUMENTS

| | | | |
|---|---|---|---|
| 94582 | 11/1897 | Fed. Rep. of Germany . | |
| 615245 | 12/1926 | France | 272/72 |
| 617163 | 2/1927 | France . | |
| 2239262 | 2/1975 | France . | |
| 640309 | 7/1950 | United Kingdom . | |
| 815011 | 6/1959 | United Kingdom . | |
| 832387 | 4/1960 | United Kingdom . | |
| 1347694 | 2/1974 | United Kingdom . | |
| 2147212A | 5/1985 | United Kingdom . | |

OTHER PUBLICATIONS

Translation of Cheron (FR., 615245) Reference.

*Primary Examiner*—Richard J. Apley
*Assistant Examiner*—D. F. Crosby
*Attorney, Agent, or Firm*—Larson and Taylor

[57] ABSTRACT

An exercise machine has a rigid base on which stands a person wishing to exercise. One or more handles extend from the base and are each connected thereto by a friction pivot assembly. The person exercises by moving the handles against the friction of the pivot assemblies. Each pivot assembly has two or more physically fixed non-parallel axes about which the corresponding handle rotates, and this allows a wide range of movement of the handles. The pivot assemblies have bearings for providing frictional resistances to movement about each axis, and those resistances are independently adjustable.

7 Claims, 6 Drawing Sheets

EXERCISE MACHINE

This application is a continuation of application Ser. No. 07/092,320 filed 02 Sept. 1987, abandoned.

BACKGROUND OF THE INVENTION

1. Field of the Invention

The present invention relates to an exercise machine.

2. Summary of the Prior Art

An enormous range of mechanical devices exists which are intended to promote physical fitness. They operate by providing resistance against which muscles can work, through the medium of weights, springs, friction, or hydraulic damping. Since the most fundamental criterion of fitness is cardio-vascular performance—the ability of the heart and lungs to support sustained physical effort—the most useful fitness machine is one which can be used to exercise, in rapid succession, every major muscle group in the body, in order to provide a sustained cardio-vascular load without over-exhausting individual muscles. It is an additional advantage if such a machine provides resistance in both directions of any given movement, so that complementary muscles are exercised simultaneously. Additionally, it is desirable for the design to be such that a user is unlikely to sustain injury as a result of inexperience, and for the machine to be as light and compact as possible.

Many exercise machines have been proposed in which one or more handles are attached to a base by a pivot assembly. The most widely used pivot assembly is a ball-and-socket joint, and examples of such exercise machines are shown in GB 832387, GB 1347694, GB 2147212, U.S. Pat. Nos. 605,747, 1,535,391, 2,909,371, 3,428,311, 4,249,727 and FR 617163. It has also been disclosed in DE 94582 to use a hook-and-eye joint. Some of these exercise machines allow relatively free movement of the handle(s) but in most of them the pivot assembly contains means for providing a frictional resistance to movement (often variable) to provide a measure of stability or support for the user in some exercise positions.

However, despite the large number of such proposals, none has found practical success. The reason for this is thought to be that the shape of the socket required to retain the ball during exercise constrains the degree of movement of the handle. This is particularly important when the machine is not simply a "fun exercise" machine to assist the user to move to a variety of positions, but is intended to be used to provide a sustained cardio-vascular load. Then a controlled freedom of movement of the handles at the pivot assembly is necessary, in association with suitable resistance to movement and this cannot be provided by a simple ball and socket joint. In any ball-and-socket joint, the provision of resistance conflicts with the freedom of movement of the ball, and in practice the ball-and-socket must either be firmly clamped in place, or can move relatively freely. It is very difficult to give resistance to movement which does not effectively clamp the ball.

SUMMARY OF THE INVENTION

Therefore according to the present invention, the pivot assemblies have physically defined axes about which the handle moves relative to the base. By defining the axis in a physical way, rather than merely allowing rotation about any suitable axis through a ball joint, the desired freedom of movement may be achieved conveniently, and yet provide the necessary resistance to give sustained cardio-vascular loads.

In order to ensure satisfactory load, the movement about one or more of the axes is resisted by a suitable pre-set frictional resistance generated by means in the pivot assembly. Preferably the frictional resistance is variable, and in this case it is possible either for the resistance to be independently adjustable for each axis, or for the resistance on all the axes to be adjustable in synchronism.

Normally there will be two axes, and each may be formed by bearings in the form of pairs of abutting conical surfaces, the friction between those surfaces providing the resistance to movement.

BRIEF DESCRIPTION OF THE DRAWINGS

Embodiments of the invention will now be described in detail, by way of example, with reference to the accompanying drawings, in which.

DETAILED DESCRIPTION

Figure 1:
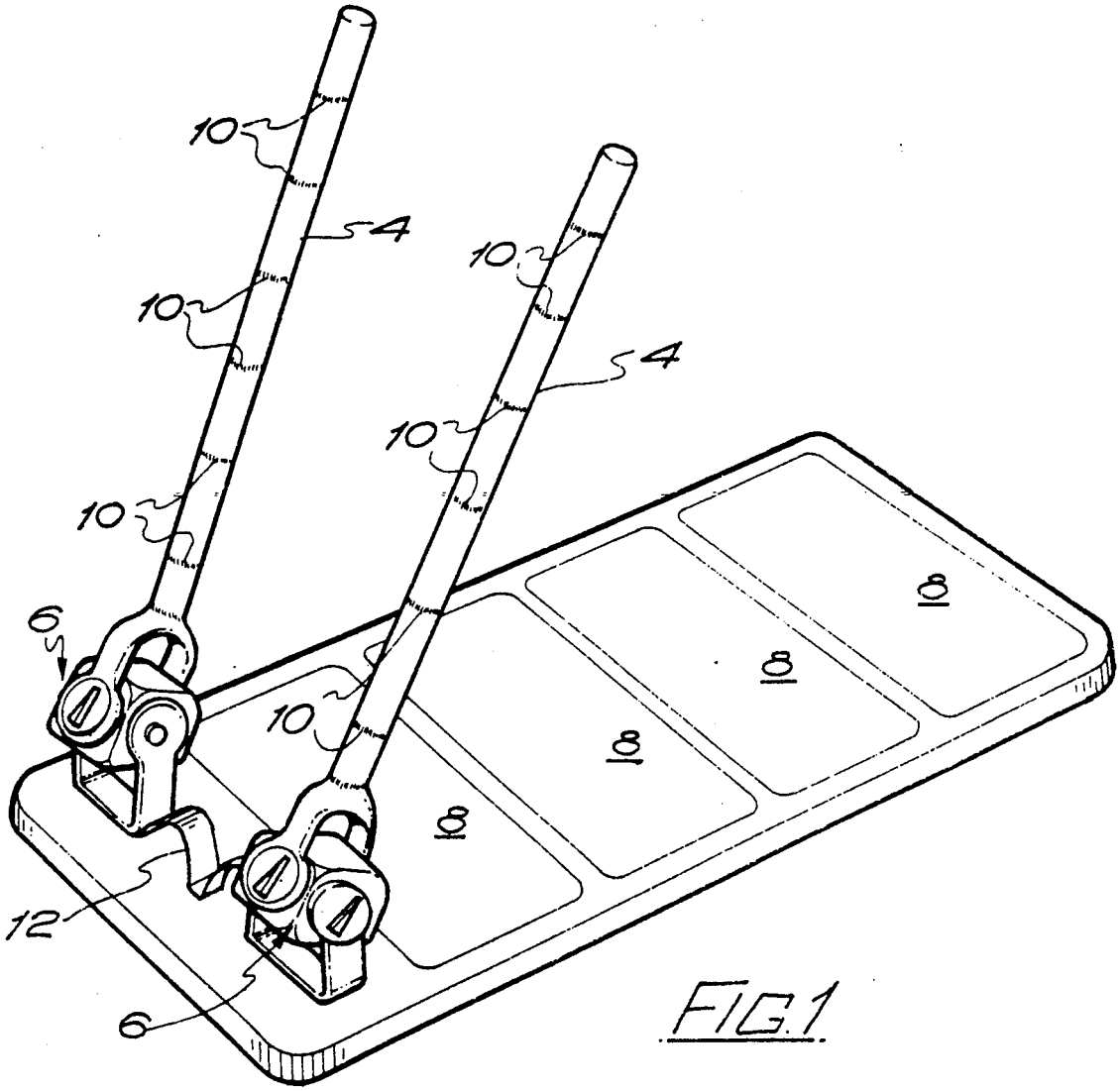
FIG. 1 shows a general view of a first embodiment of an exercise machine according to the present invention.

Referring first to FIG. 1, an exercise machine being a first embodiment of the invention has a rigid baseboard 2, and a pair of handles 4 of such a length as to reach approximately to the shoulder height of a person standing on the baseboard. Each of the handles 4 is attached at its lower end to a universal friction pivot assembly 6 mounted adjacent to one end of the baseboard 2, such that the handle 4 is capable of omni-direction movement about a point approximately in the centre of the corresponding pivot assembly 6, against a predetermined frictional resistance. A person standing on the baseboard 2 and grasping the handles 4 may then perform a wide variety of exercises in which each movement is opposed by a resistance determined by the position at which the handles 4 are grasped, and the friction developed in the pivot assembly 6.

It is advantageous, although not essential, for the baseboard 2 to have a non-slip surface 8, which may conveniently be arranged in patches such that the divisions between them serve as datum marks to assist users to position themselves to be able to repeat exercises consistently. Similarly, the handles 4 may have position markings 10 to facilitate repeating a precise position of grip. The provision of foot straps 12 assists the user in performing a range of exercises; carried out in a seated position. On the underside of the base 2, and not visible in the illustration, are shallow feet which minimise the risk of the base rocking if the floor on which it stands is slightly uneven. It is desirable for such feet to provide enough clearance between the base and the floor for the fingers of a user who wishes to grip the edges of the base while performing certain exercises or to lift the base in order to move the machine; alternatively, a recess (not shown in the illustration) can be formed around the lower edge of the base to afford the same facility.

Figure 2:
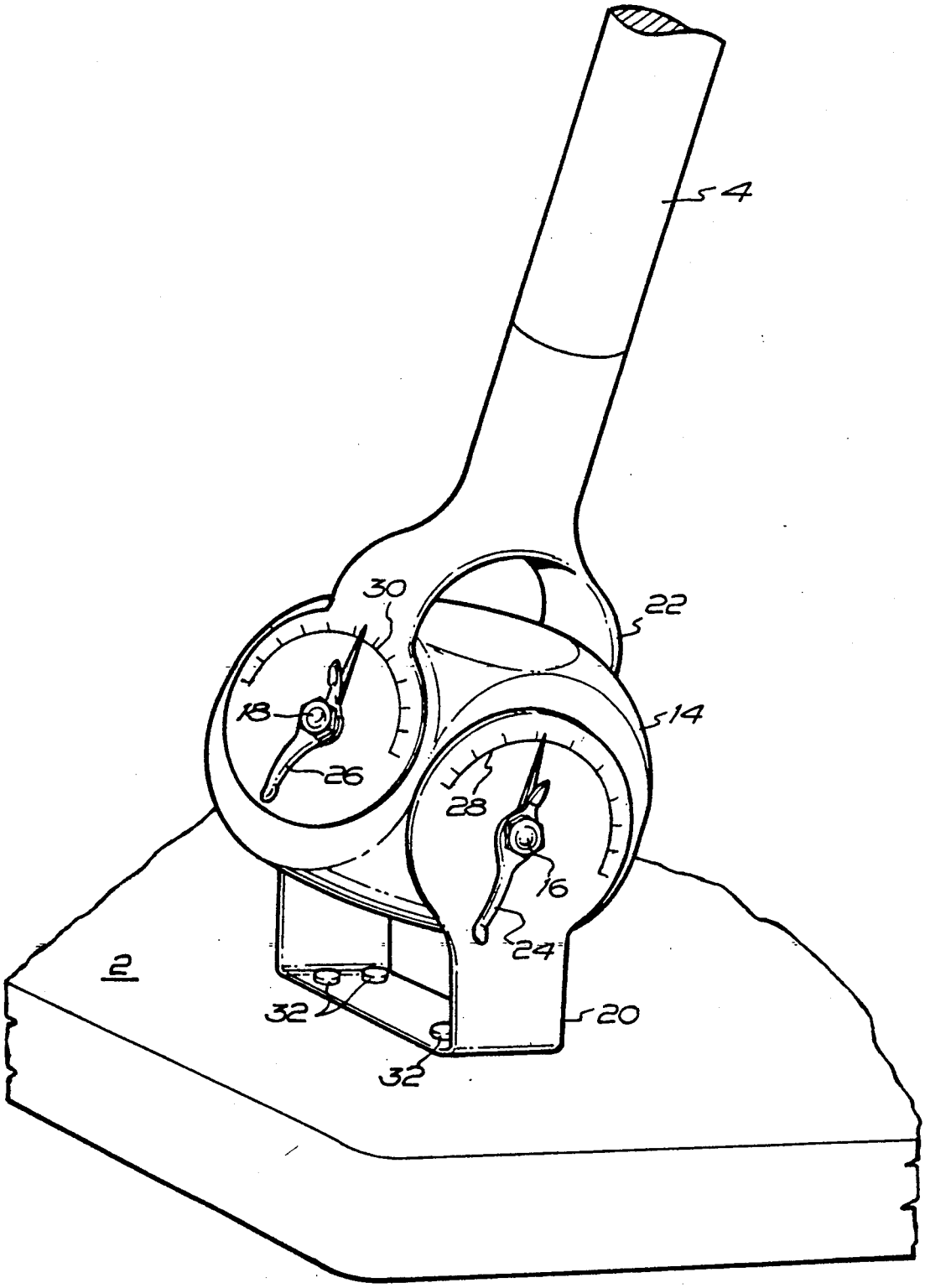
FIG. 2 illustrates in more detail the design of one of the universal friction pivots of the machine of FIG. 1.

One of the universal friction pivot assemblies 6 shown in FIG. 1 is illustrated in more detail in FIG. 2. Essentially, the assembly consists of a block 14 which is of a shape approximating to a cube, but slightly elongated in one direction, and with the corners rounded off. Shafts 16 and 18, which define substantially perpendicular axes, but do not intersect, pass through the block 14 and through trunnions 20 and 22 respectively. The trunnion 20 is attached to the base 2 (only a part of which is shown) by screws 32, and the trunnion 22 is connected to the handle 4. The friction about the rotation axes defined by the shafts 16 and 18 is controlled by hand operated nuts 24 and 26 respectively, operating on the threaded ends of shafts 16 and 18, and with indications of the settings being provided by scales 28 and 30.

Figure 3:
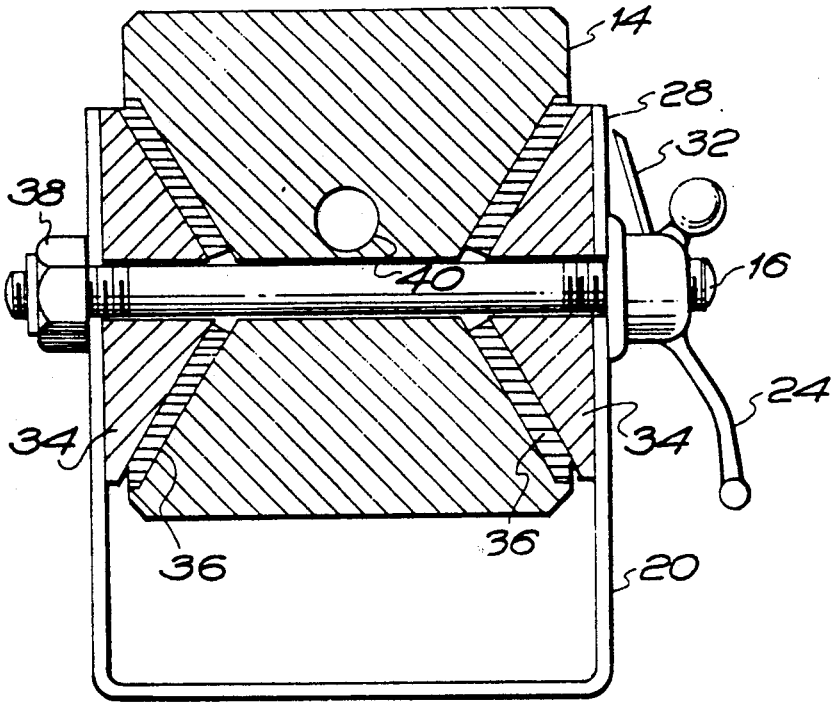
FIG. 3 represents a cross section through one of the rotation axes of the pivot assembly shown in FIG. 2.

The construction of the universal friction pivot assembly shown in FIG. 2 is illustrated in more detail in FIG. 3, which represents a part section through the rotation axis 16. The block 14, which may conveniently be of metal or reinforced plastic, carries conical friction surfaces 36, which are engaged by cones 34, typically of metal, attached to the trunnion 20. The means of attachment of cones 34 to trunnion 20 are not shown in the drawing; they may be welded or bonded by adhesive if the trunnion 20 is sufficiently flexible to enable it to be sprung in and out of position, or they may be attached by screws to facilitate assembly. Another form of construction (not shown) is for the cones 34 to be permanently attached to the trunnion 20, but for the trunnion 20 itself to be made in two pieces. The friction between the block 14 and the trunnion 20 is controlled by the setting of the hand nut 24 applying tension to the shaft 16. The actual setting of the nut 24 is indicated by the pointer 32 in relation to the scale on the trunnion 20 in the position indicated at 28. The zero of the scale 28 is set by adjusting the hand nut 24 so that the pointer 32 reads zero, and then screwing up the self-locking nut 38 until all free play is eliminated, and any further movement would generate tension in the shaft 16. The hole 40 in the block 14 represents the position of the transverse axis 18 shown in FIG. 2, which has an arrangement of conical friction faces, cones, hand nut 26 (FIG. 2), scale 30 (FIG. 2), and zero setting nut similar to the axis shown in FIG. 3.

For some exercises requiring substantial frictional resistance, the degree of force which has to be applied to the hand nuts 24 and 26 of FIG. 2 in order to generate sufficient clamping force in the respective shafts 16 and 18 can present a problem. This arises from the limitation in angular rotation imposed by the necessity for the pointers and the hand nuts 24 and 26 to remain within the extent of the respective scales 28 and 30, in order unambiguously to represent the friction setting.

Figure 4:
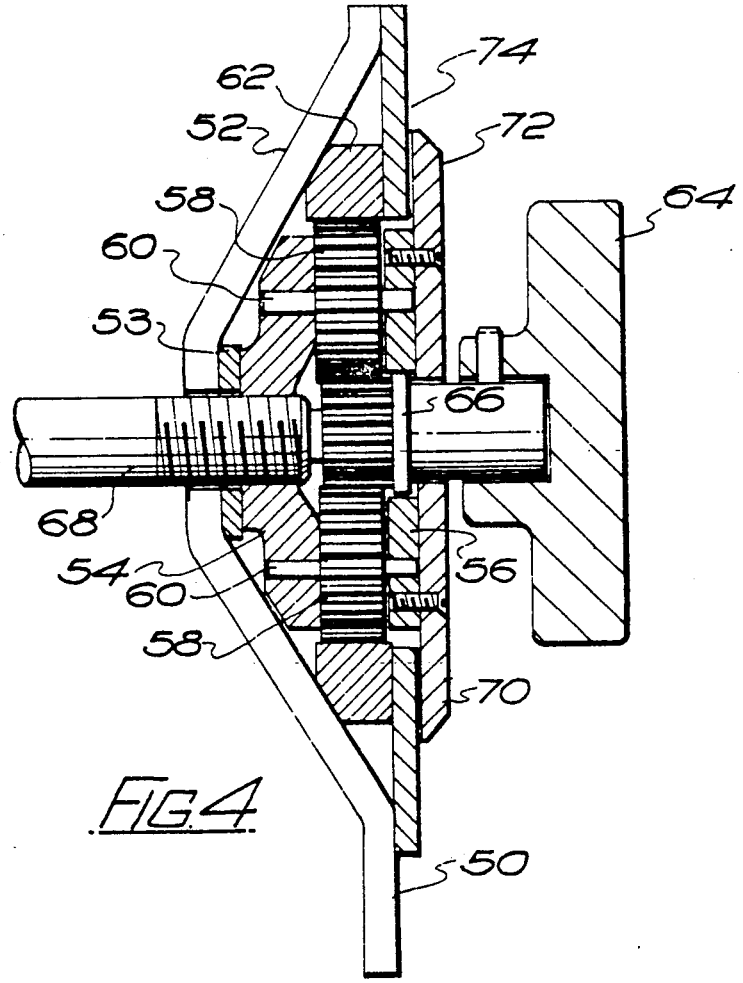
FIG. 4 is a cross-section through one end of a rotation axis similar to that of FIG. 3, but having an alternative form of friction adjustment.

FIG. 4 illustrates a means of overcoming this difficulty, by including a form of reduction gearing through which the friction adjusting nut can be driven. The trunnion 20 and cone 34 of FIG. 2 are replaced by a modified trunnion 50 (only a portion of which is shown) on which a conical surface 52 is formed, thus creating a cavity in which the geared drive can be accommodated. The friction adjusting nut 54 which engages the threaded portion of the shaft 68 and applies load to the conical portion 52 of the trunnion 50 through the thrust washer 53, forms part of a cage 54, 56 and 60 carrying a number of planetary gears 58 on shafts 60. The said planetary gears 58 mesh with an internally toothed ring 62 attached to the inside of the conical cavity. The handwheel 64 drives a gear 66 which is carried on an extension of said shaft 68 and meshes with said planetary gears 58. It will be seen that the complete assembly constitutes an epicyclic reduction gear capable of providing a significant mechanical advantage between the handwheel 64 and the friction adjusting nut 54. The handwheel 64 and gear 66 are retained in position by the plate 70 which is attached to the cage portion 56. The plate 70 carries adjacent to its circumference a scale 72 which is read against an index mark on the cover 74.

Figure 5:
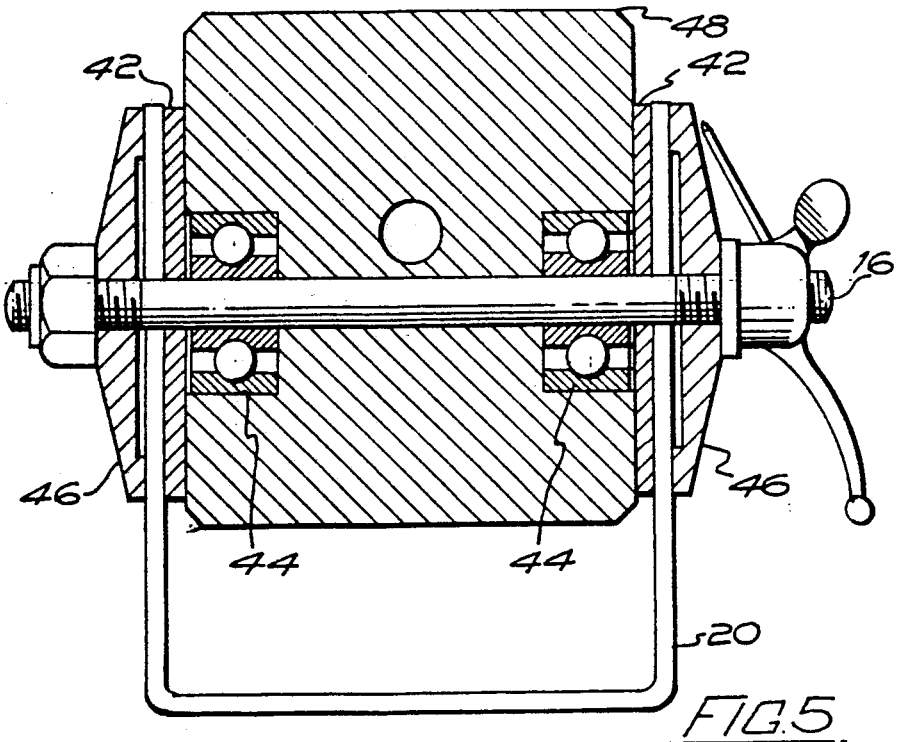
FIG. 5 illustrates an alternative design of rotation axis for the pivot assembly shown in FIG. 2.

Although the conical friction surfaces illustrated in FIG. 3 have the advantage that they also act as bearings to resist the torque action about the other axis, circumstances could arise in which it is advantageous to employ flat friction faces, and a possible arrangement embodying this is illustrated in FIG. 5. The block 14 of FIGS. 2 and 3 is replaced by a block 48 which carries flat friction faces 42, and the journal loads between the shaft 16 and the block 48, formerly resisted by the conical friction surfaces, are now taken by ball journal bearings 44. Ball bearings are illustrated by way of example, although plain bearings of low friction material would constitute a practicable alternative. Because the flat surfaces of the trunnion 20 have little inherent stiffness, load spreading disks 46 are used to ensure that the clamping force generated in the shaft 16 is well distributed over the friction surfaces.

Figure 6:
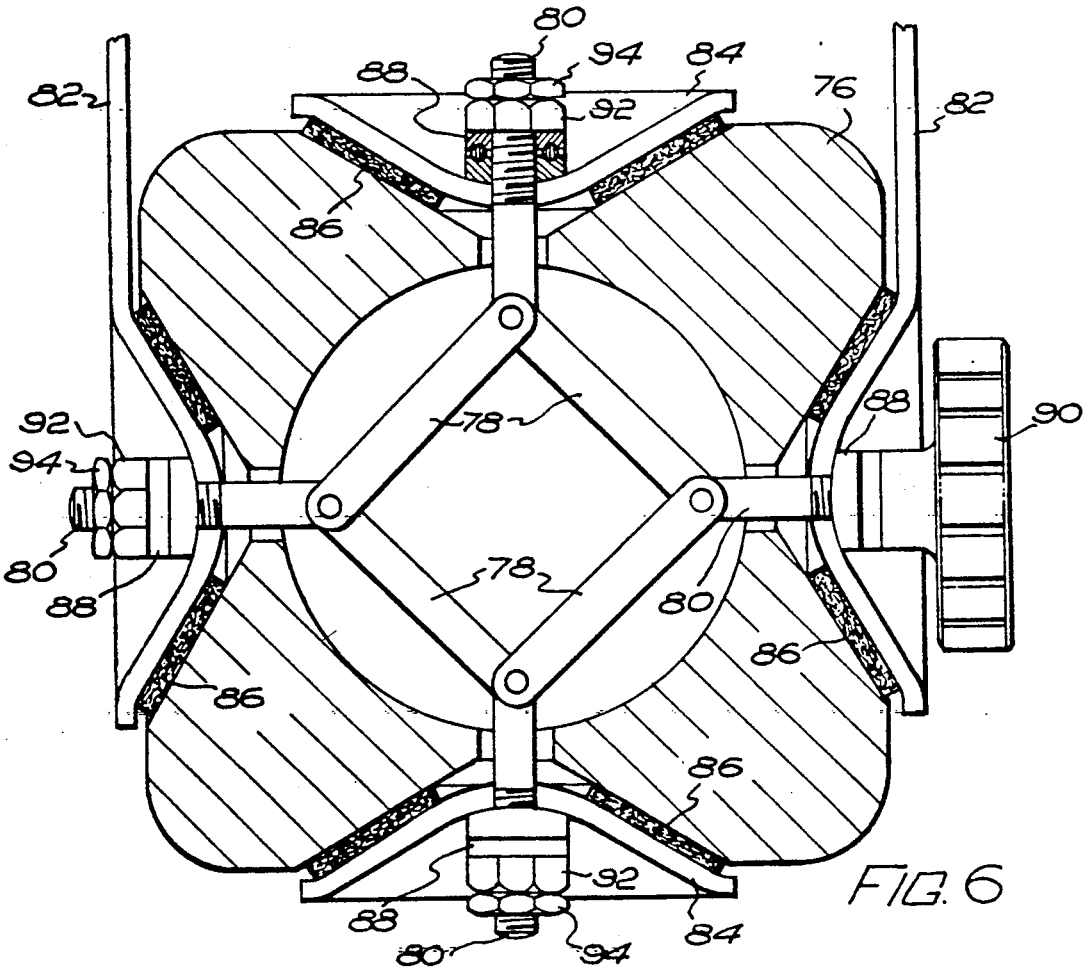
FIG. 6 shows an alternative arrangement of the rotation axes for the pivot assembly shown in FIG. 2, incorporating a means of balancing the friction on the two axes.

One feature of the universal friction pivots illustrated in FIGS. 1 to 5 is that the friction loads on the two axes are adjustable independently. For those applications in which the friction loads on the two axes are required to be different, this is ideal, but there may well be other applications in which the friction loads on the two axes are required to be the same, and in these cases it may be regarded a nuisance to have to set each independently. FIG. 6 represents a cross-section through a universal friction pivot assembly constructed in such a way that one control adjusts the friction on both axes simultaneously. In this example the block 76 has a cavity in the centre which accommodates a parallelogram assembly consisting of four links 78 pivotally connected to each other and to four shafts 80, the tension in which assembly controls the friction between the trunnions 82, 84 (only portions of which are shown) and the friction faces 86 attached to said block 76. Because the shafts 80 are constrained by the links 78 so that they cannot rotate with the trunnions 82, 84 the tension loads in said shafts 80 are transmitted to said trunnions 82, 84 through thrust bearings 88, having spherical seatings on trunnions 82, 84 to accommodate angular misalinement. The tension in each of said shafts 80 is controlled by a handwheel 90 which is carried on the threaded end of one of said shafts 80, while each of the other three shafts 80 carries an adjusting nut 92 and a locknut 94, the purpose of which is to enable the assembly to be adjusted so that links 78 are in the form of a square: the necessary condition for the tension loads in the four shafts 80 to be equal, and hence the frictional forces between the block 76 and each of the trunnions 82 and 84 to be equal. It is, of course, equally possible for the adjusting nuts 92 to be set so that the links 78 take up the form not of a square but of a rhombus; the frictional forces developed between the two trunnions 82, 84 and and the block 76 will then not be identical, but will remain in a substantially constant ratio as the handwheel 90 is adjusted.

Figure 7:
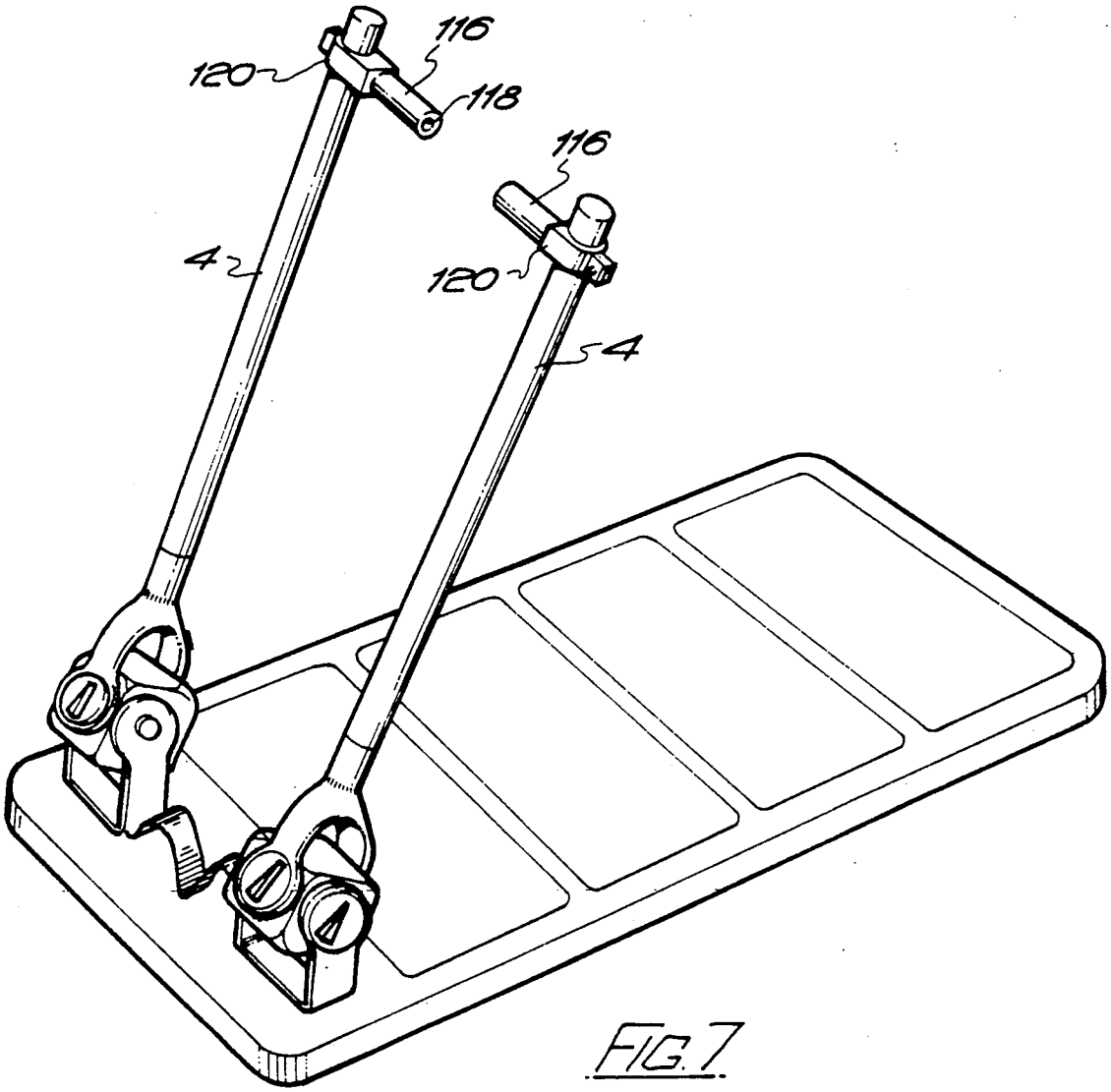
FIG. 7 illustrates a design for a handle attachment which extends the range of application of the machine.

The range of exercises which can be performed on the machine can be extended by the use of pivoted hand grips fitted as shown in FIG. 7 at right angles to the handles 4. The attachment consists of a hand grip 116 which can rotate on a shaft 118 carried in a block 120 which is clamped rigidly to the handle 4. The means of clamping the block 120 to the handle 4 is in accordance with conventional engineering practice and is not shown in detail, as is the means of retaining the hand grip 116 on the shaft 118. In this case (and possibly in other cases) it is important that there is no freedom of rotation about an axis parallel to the longitudinal axis of the handles 4.

Figure 8:
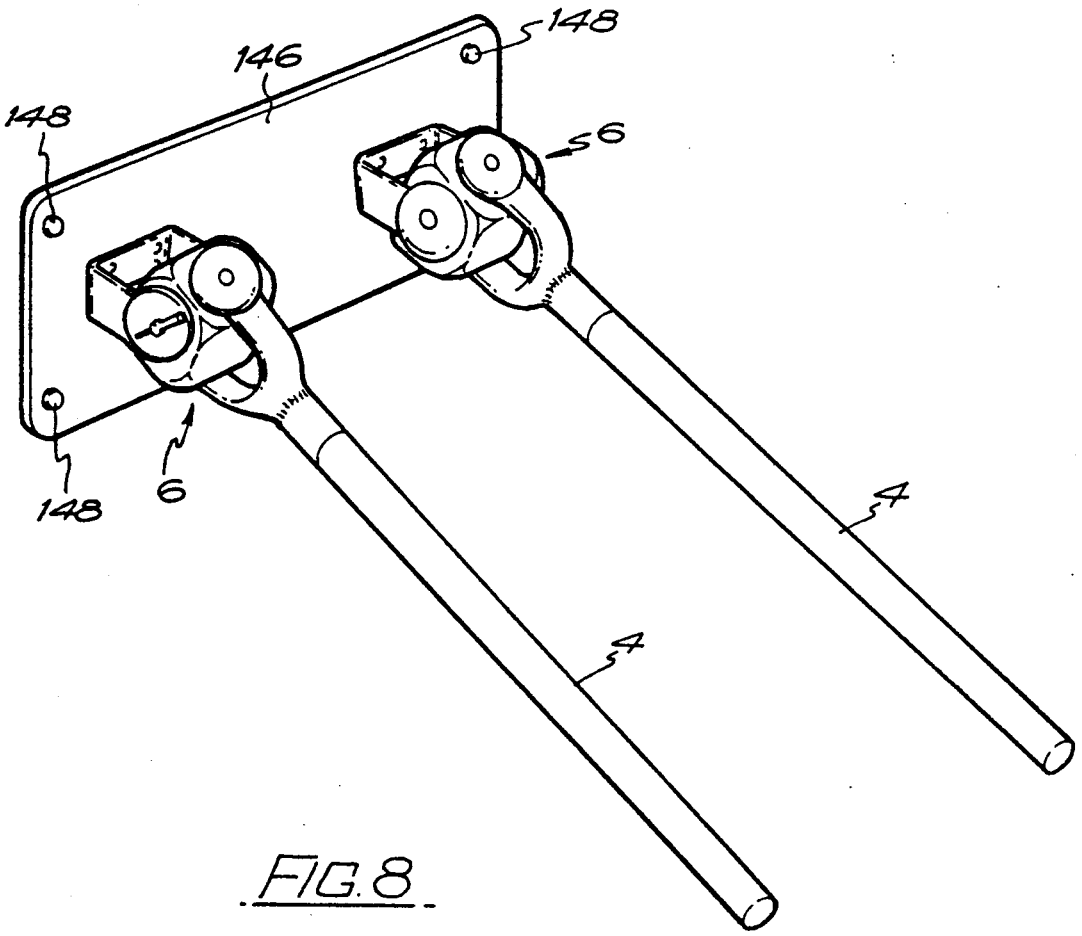
FIG. 8 shows a second embodiment of an exercise machine, according to the present invention, which is wall mounted for use by bed-ridden patients.

Although many of the exercises for which the machine is suitable may be performed equally by a handicapped person seated in a chair, or in a wheelchair, positioned on the base 2, others, and particularly the bed-ridden, will find it advantageous for the friction pivots to be attached to a wall, as illustrated in FIG. 8. The two universal friction pivot assemblies 6 carrying the handles 4 are mounted on a baseboard 146 which is in turn attached to the wall by bolts 148. It will be evident that it is equally practicable for the baseboard 146 to be attached to the floor rather than to the wall, or even to the ceiling.

The foregoing description of the machine and its various embodiments are by way of illustration, and detailed variations may be introduced to suit it more precisely to a specific application. Thus, for example, when the machine is intended for use by the disabled, the hand nuts 24 and 26 of FIG. 2 can be extended to facilitate adjustment of the frictional force. Further, although for simplicity the friction adjustments have been drawn as nuts on threaded shafts, it will be evident that if the application warranted it, screws or hydraulic thrusters could be used to apply the required loads to the friction surfaces. Again, although simple flat and conical friction surfaces are depicted in the illustrations, for applications involving heavier use it would be entirely practicable to reconfigure them with disk brakes.

We claim:

1. An exercise machine comprising:

a rigid base;

at least one handle; and at least one friction pivot assembly connecting said at least one handle to said rigid base, said at least one pivot assembly having at least two physically defined non-parallel pivot axes, said at least one handle being movable relative to said base about said axes, said at least one pivot assembly also comprising a rigid element having first and second pairs of opposite sides, a first shaft connected to said handle to define a first one of said pivot axes, a second shaft connected to said base to define a second one of said pivot axes and being offset from said first shaft, said first and second shafts being linked by said rigid element, a first pair of resistance means associated with said first shaft for providing frictional resistance to movement of said handle about said first one of said pivot axes, first adjustment means connected to said first shaft for adjusting simultaneously the degrees of frictional resistance for said first pair of resistance means, a second pair of resistance means associated with said second shaft for providing frictional resistance to movement of said block about said second one of said pivot axes, and second adjustment means, independent of said first adjustment means, connected to said second shaft for adjusting simultaneously the degrees of frictional resistance for said second pair of resistance means so that the degrees of frictional resistances for each of said axes are independently adjustable for each of said axes.

2. An exercise machine according to claim 1, wherein the at least two axes are substantially at 90° to each other.

3. An exercise machine according to claim 1, having bearings for each of said axes, said bearings forming each of said resistance means.

4. An exercise machine according to claim 3, wherein each of said bearings comprises a corresponding pair of abutting conical surfaces, each of said pairs of conical surfaces having a corresponding common symmetry axis, said common symmetry axis is collinear with a corresponding one of said non-parallel axes.

5. An exercise machine according to claim 4, having means for adjustably forcing together each of said pairs of conical surfaces, thereby to vary said frictional resistance.

6. An exercise machine according to claim 1 having at least one footstrap on said rigid base adjacent said at least one friction pivot assembly.

7. An exercise machine according to claim 1, having a rotatable hand grip on said at least one handle.

* * * * *